US009562413B2

(12) United States Patent
Hiorth

(10) Patent No.: US 9,562,413 B2
(45) Date of Patent: Feb. 7, 2017

(54) PLUGGING DEVICE

(75) Inventor: Espen Hiorth, Trondheim (NO)

(73) Assignee: Interwell Technology AS, Ranheim (NO)

( * ) Notice: Subject to any disclaimer, the term of this patent is extended or adjusted under 35 U.S.C. 154(b) by 454 days.

(21) Appl. No.: 14/119,546

(22) PCT Filed: May 31, 2012

(86) PCT No.: PCT/EP2012/060321

§ 371 (c)(1),
(2), (4) Date: Nov. 22, 2013

(87) PCT Pub. No.: WO2012/164053

PCT Pub. Date: Dec. 6, 2012

(65) Prior Publication Data

US 2014/0076539 A1 Mar. 20, 2014

(30) Foreign Application Priority Data

Jun. 3, 2011 (NO) ..... 20110809

(51) Int. Cl.
*E21B 33/12* (2006.01)
*E21B 33/128* (2006.01)

(52) U.S. Cl.
CPC ..... *E21B 33/12* (2013.01); *E21B 33/128* (2013.01); *E21B 33/1208* (2013.01); *E21B 33/1216* (2013.01)

(58) Field of Classification Search
CPC .... E21B 33/12; E21B 33/128; E21B 33/1208; E21B 33/1216
See application file for complete search history.

(56) References Cited

U.S. PATENT DOCUMENTS 2,797,759 A 7/1957 Long et al.
3,436,084 A 4/1969 Courter
(Continued)

FOREIGN PATENT DOCUMENTS

EP 1 780 373 A1 5/2007
GB 2296520 A 7/1996
(Continued)

OTHER PUBLICATIONS

International Search Report issued in PCT/EP2012/060321 mailed on Sep. 4, 2013 (5 pages).
(Continued)

*Primary Examiner* — Brad Harcourt
(74) *Attorney, Agent, or Firm* — Osha Liang LLP

(57) ABSTRACT

The present invention relates to a plugging device (1) comprising a housing (10), a packer device (2), a first supporting assembly (3) supporting a first side (2*a*) of the packer device (2) in the expanded state and a second supporting assembly (4) supporting a second side (2*b*) of the packer device (2) in the expanded state. The packer device (2) is provided circumferentially around the housing (10); where the packer device (2) is configured to be provided in a retracted state and an expanded state, where the radial radius (R2) of the packer body (20) in the expanded state is larger than the radial radius (R1) of the packer body (20) in the retracted state. The packer device (2) comprises a packer body (20) and a supporting device (30) for supporting the packer body (20) in the expanded state. The first and second sides (2*a*, 2*b*) of the packer device (20) and/or the supporting device (30) have the same circumference (C) in the retracted state and the expanded state, where the circumference (C) is larger than the circumference ($C_{10}$) of the housing (10).

11 Claims, 7 Drawing Sheets

(56) References Cited

U.S. PATENT DOCUMENTS

| | | | | |
|---|---|---|---|---|
| 4,375,240 | A * | 3/1983 | Baugh | E21B 33/1295 166/120 |
| 4,379,558 | A | 4/1983 | Pippert | |
| 4,509,763 | A * | 4/1985 | Fischer | E21B 33/1208 267/1.5 |
| 5,676,384 | A | 10/1997 | Culpepper | |
| 2002/0014339 | A1 | 2/2002 | Ross | |
| 2003/0047880 | A1 | 3/2003 | Ross | |
| 2004/0149429 | A1 | 8/2004 | Dilber et al. | |
| 2006/0290066 | A1 | 12/2006 | Hiorth | |
| 2010/0122820 | A1 | 5/2010 | Holland | |
| 2011/0061857 | A1 | 3/2011 | White | |

FOREIGN PATENT DOCUMENTS

| | | | |
|---|---|---|---|
| NO | 20101759 | A1 | 6/2012 |
| WO | 2011/037581 | A1 | 3/2011 |
| WO | 2011/037584 | A1 | 3/2011 |
| WO | 2011/037586 | A1 | 3/2011 |

OTHER PUBLICATIONS

Written Opinion of the International Searching Authority issued in PCT/EP2012/060321 mailed on Sep. 4, 2013 (7 pages).
Norwegian Search Report issued in Application No. 20110809 dated Dec. 20, 2011 (2 pages).
International Search Report issued in corresponding application PCT/EP2012/060319 mailed on Jul. 22, 2013 (2 pages).
Written Opinion of the International Searching Authority issued in corresponding application PCT/EP2012/060319 mailed on Jul. 22, 2013 (3 pages).

* cited by examiner

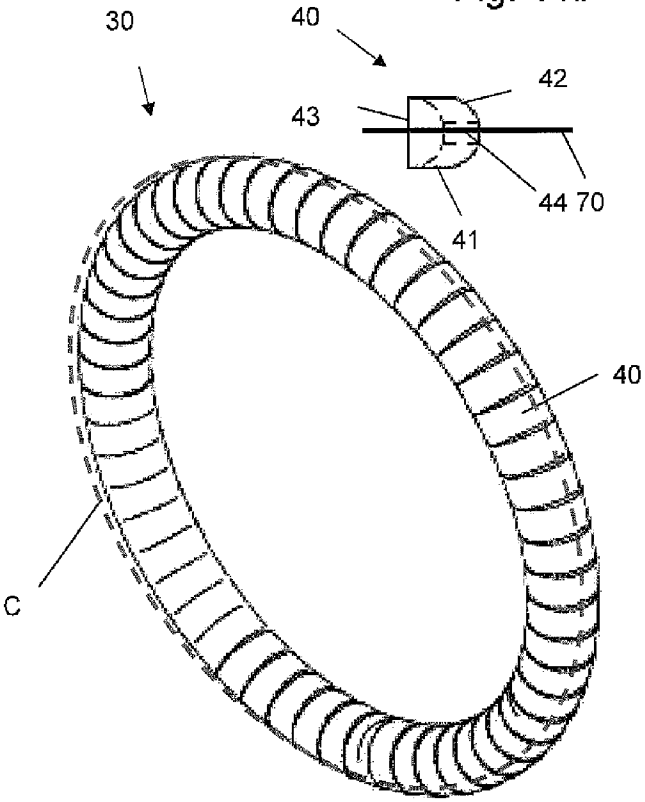
Fig. 11b
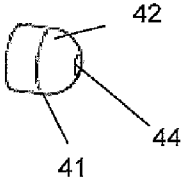
Fig. 11c
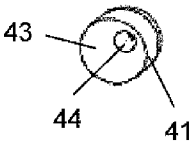
Fig. 11d
Fig. 11a

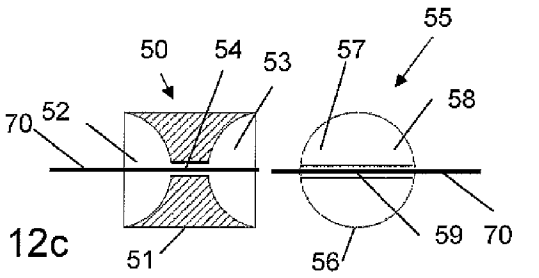
Fig. 12c
Fig. 12d
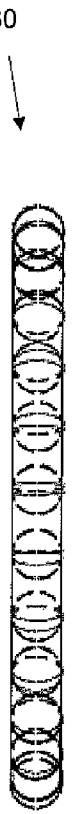
Fig. 12b
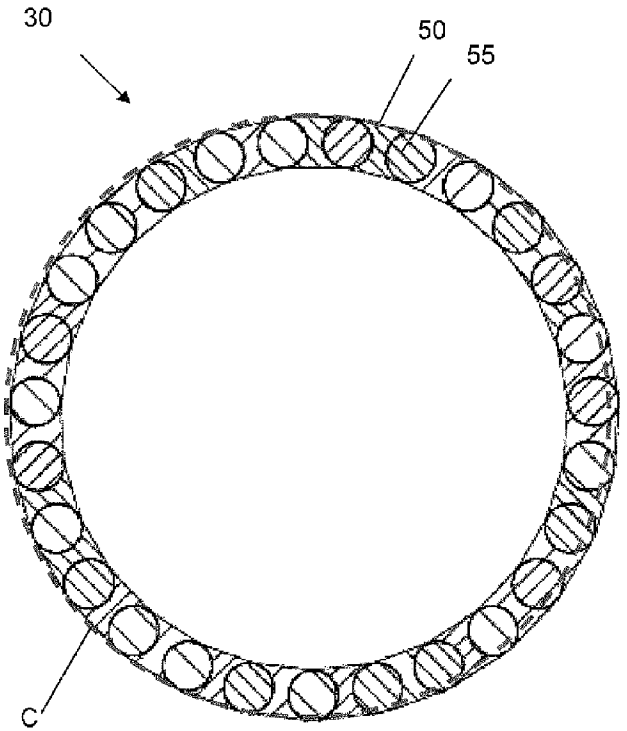
Fig. 12a

PLUGGING DEVICE

CROSS-REFERENCE TO RELATED APPLICATIONS

This application is a National Stage application of International Patent Application No. PCT/EP2012/060321, filed on May 31, 2012, which claims priority to Norwegian Patent Application No. 20110809, filed on Jun. 3, 2011. Both priority applications are hereby incorporated by reference in their entirety.

FIELD OF THE INVENTION

The present invention relates to a plugging device. More specific, the invention relates to a plugging device for sealing against an inner surface of a pipe. The invention also relates to a packer body for sealing against an inner surface of a pipe.

BACKGROUND OF THE INVENTION

Many types of plugging devices for sealing against the inner wall of a pipe are known. Typically such plugging devices are used in the pipes of oil and/or gas wells or oil and/or gas production equipment, but they may also be used in other applications. Such plugging devices comprise a packer device provided circumferentially around the plugging device.

The packer device is in a retracted state during the transportation of the plugging device to the desired location in the pipe. At the desired location, the packer device is brought to an expanded state, for sealing against the inner wall of the pipe. The packer device comprises a packer body made of an elastic or ductile material in order to be brought between the retracted and the expanded states, and in order to seal against the inner wall of the pipe. The packer body is subjected to extrusion forces which may deform the packer body so much that it becomes damaged. In order to reduce the extrusion of the packer body, a supporting device or so-called backup ring is often incorporated into the packer body. The supporting device is also provided circumferentially around the plugging device.

One typical supporting device is a coil spring. However, when a spring is expanded due to the movement from the retracted state to the expanded state, the distance between each turn of the spring increases, allowing the ductile material of the packer body to extrude in between the openings between the respective turns. Moreover, the ductile material which has extruded into the openings between the respective turns will obstruct the spring to return to its retracted state when there is a need to retrieve the plugging device from the pipe. Hence, the plugging device may have a larger outer diameter during transportation out from the pipe than during transportation into the pipe, which may cause the plugging device to get stuck.

It is known to provide a core unit inside a spring, for example as in US 2006/0290066. Here the core unit comprises several interlinked elements, each having a first end connected to a second end of an adjacent element. Also here the distance between each element increases in the expanded state, allowing the material of the packer body to extrude between the openings of the spring and the opening between the elements.

From U.S. Pat. No. 4,379,558 it is also known to provide a flat wire spring on the outside of the coiled spring, where the flat wire spring has overlapping contiguous elements forming a tubular encasement for the spring. It is difficult to provide the flat wire spring sufficiently strong, and the production of it is complex.

The object of the invention is to provide a packer device with a supporting device where the disadvantages above are avoided. One object of the present invention is to avoid the use of a coil spring in the supporting device.

SUMMARY OF THE INVENTION

The present invention relates to a plugging device comprising:

- a housing;
- a packer device provided circumferentially around the housing; where the packer device is configured to be provided in a retracted state and an expanded state, where the radial radius of the packer body in the expanded state is larger than the radial radius of the packer body in the retracted state;
- a first supporting assembly supporting a first side of the packer device in the expanded state;
- a second supporting assembly supporting a second side of the packer device in the expanded state;

where the packer device comprises a packer body and a supporting device for supporting the packer body in the expanded state;

characterized in that the first and second sides of the packer device and/or the supporting device have the same circumference in the retracted state and the expanded state, where the circumference is larger than the circumference of the housing.

In one aspect, the packer body and the supporting device are provided as one body made of the same material.

In one aspect, the material of the packer body and the supporting device is a ductile or semi-ductile material.

In one aspect, the packer body is provided in a groove in the supporting device.

In one aspect, the first side of the packer device comprises at least one first contact area in which the packer device is in contact with the first supporting assembly in the retracted state;

- the second side of the packer device comprises at least one second contact area in which the packer device is in contact with the second supporting assembly in the retracted state;
- a distance D22 between an area longitudinally opposite of the at least one first contact area and the second supporting assembly is larger than zero;
- a distance D24 between an area longitudinally opposite of the at least one second contact area and the second supporting assembly is larger than zero.

In one aspect, the first side of the packer device comprises two first contact areas and where the second side of the packer device comprises two second contact areas.

In one aspect, the first side of the packer device comprises six first contact areas and where the second side of the packer device comprises six second contact areas.

In one aspect, the supporting device comprises a chain comprising interconnected chain elements.

In one aspect, the chain elements comprises an outwardly curved front end and an inwardly curved rear end, where the front end is adapted to be received by the rear end of an adjacent chain element.

In one aspect, the front end is outwardly hemispherical and the rear end is inwardly hemispherical.

In one aspect, the chain elements comprises:

a first chain element comprising an inwardly curved front end and an inwardly curved rear end, a second chain element comprising an outwardly curved front end and an outwardly curved rear end;

where the outwardly curved front end of the second chain element is adapted to be received by the inwardly curved rear end of the first chain element and the outwardly curved rear end of the second chain element is adapted to be received by the inwardly curved front end of the first chain element.

In one aspect, the chain elements comprises a substantially cylindrical side surface between the front end and the rear end.

In one aspect, a connection bore is provided between the front end and the rear end of each chain and where a connection wire is inserted through the connection bores of each chain element.

In one aspect, the supporting device is incorporated into the packer body.

In one aspect, the packer device is oval or wave-shaped in the retracted state, and cylindrical in the expanded state.

In one aspect, the packer body is oval or wave-shaped in the retracted state, and cylindrical in the expanded state.

The invention also relates to a packer body for sealing against an inner surface of a pipe, where:

the packer body has a shape of an inclined, circular cylinder in a retracted state, where the packer body is unstrained in the retracted state;

the packer body has a shape of a circular cylinder in the expanded state, where the packer body is compressed in a direction parallel to the central, longitudinal axis of the packer body in the expanded state;

where a radial distance between the central, longitudinal axis and the outer surface of the packer body in the retracted state is less than a radial distance between the central, longitudinal axis and the outer surface of the packer body in the expanded state.

DETAILED DESCRIPTION

Embodiments of the invention will now be described with reference to the enclosed drawings, where:

Figure 5B:
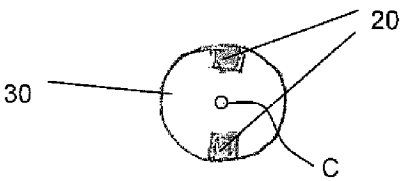
Figure 5A:
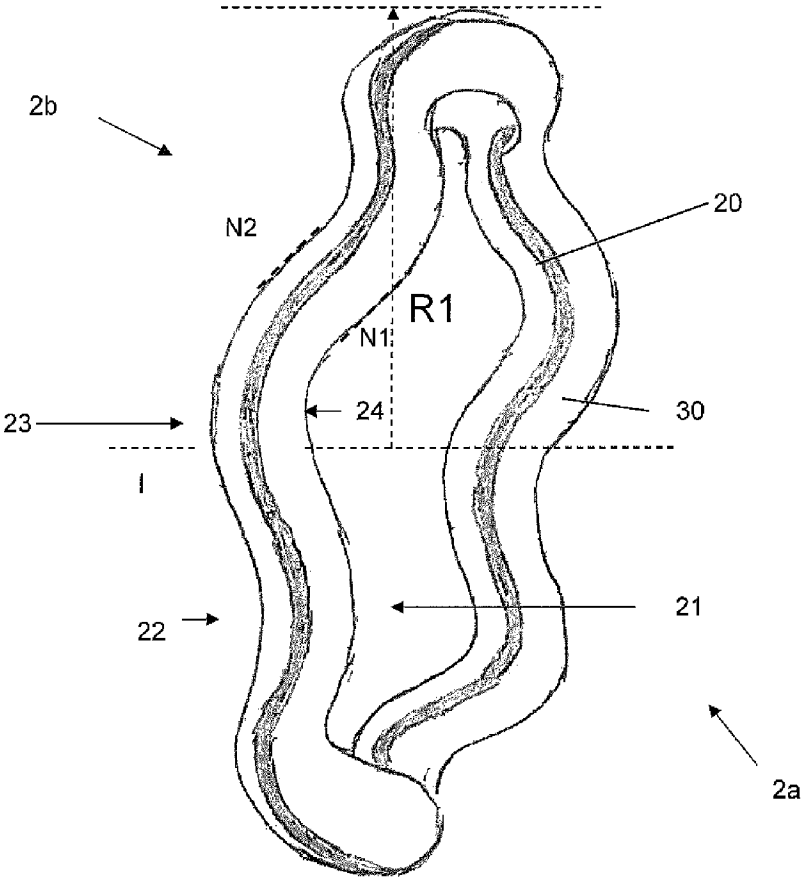

FIG. 5*a* illustrates a perspective view of a first embodiment of a packer device;

FIG. 5*b* illustrates a cross sectional view of the first embodiment in FIG. 5*a;*

Figure 7:
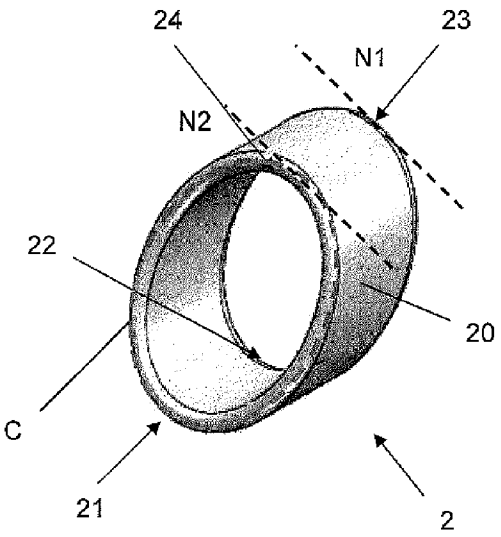
Figure 6:
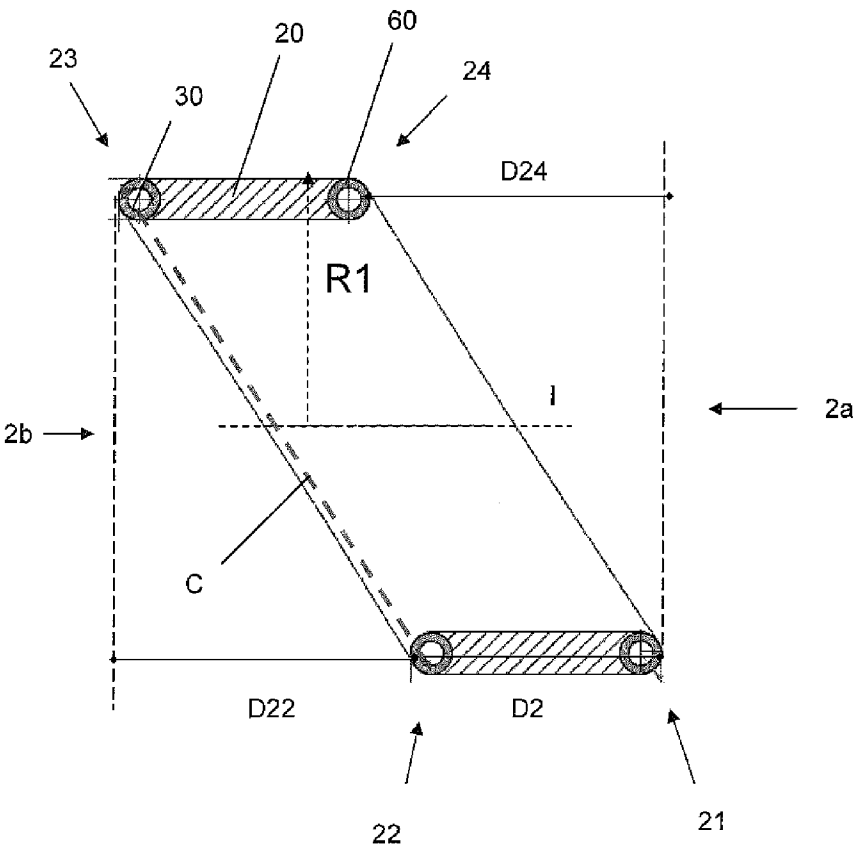
Figure 9:
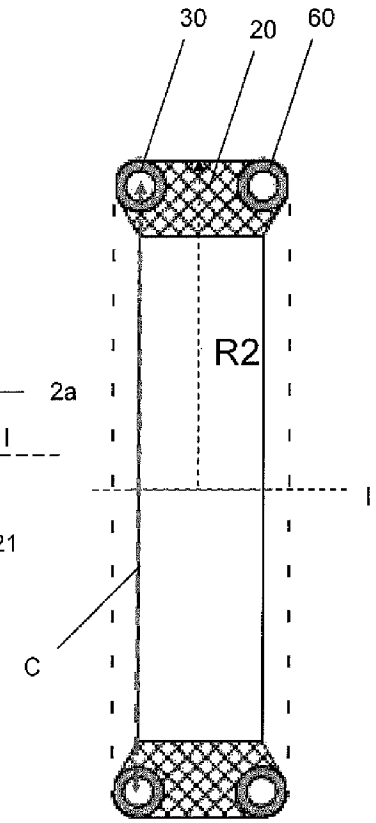
Figure 8:
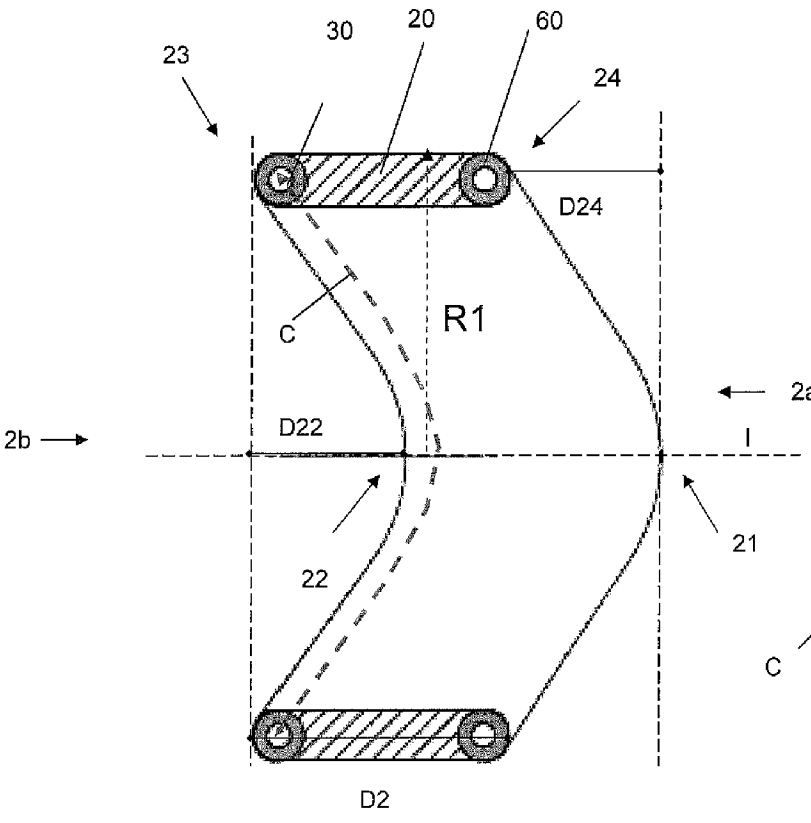
Figure 10:
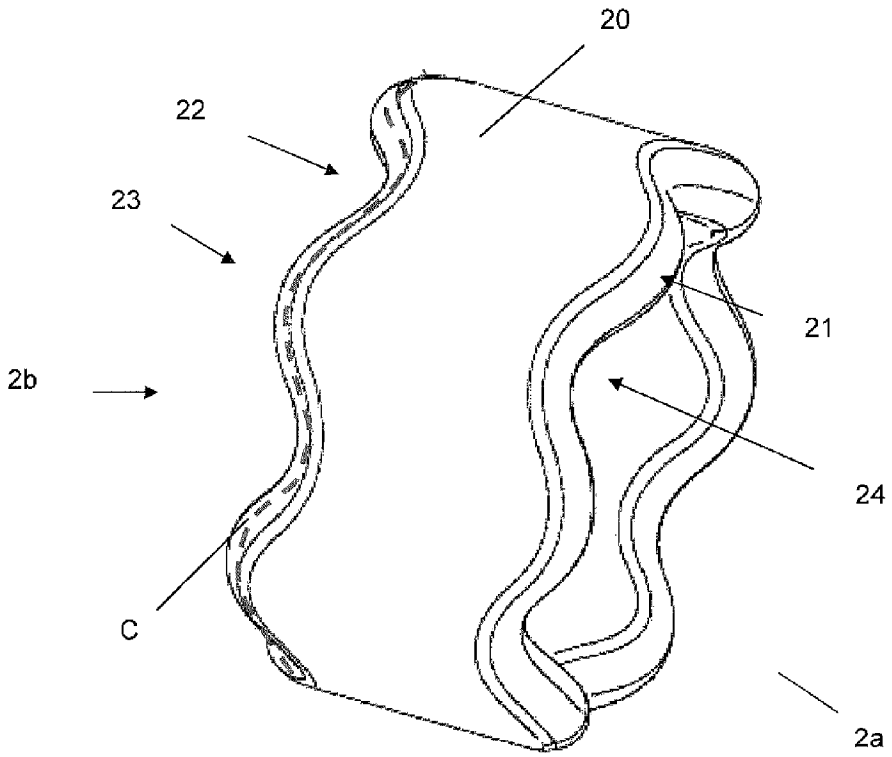

FIG. 6 illustrates a cross sectional view of a second embodiment of the packer device in the retracted state;

FIG. 7 illustrates a perspective view of the second embodiment of the packer device in the retracted state;

FIG. 8 illustrates a cross sectional view of a third embodiment of the packer device in the retracted state;

FIG. 9 illustrates a cross sectional view of the third embodiment of the packer device in the expanded state;

FIG. 10 illustrates a perspective view of a fourth embodiment of the packer device in the retracted state;

FIG. 11*a* illustrates a perspective view of a first embodiment of the supporting device;

FIG. 11*b* illustrates a cross sectional side view of a link element of the first embodiment of the supporting device;

FIG. 11*c* illustrates a perspective view of the link element of FIG. 11*b;*

FIG. 11*d* illustrates a perspective rear view of the link element of FIG. 11*b;*

FIGS. 12*a* and 12*b* illustrate a cross sectional front view and side view of a second embodiment of the supporting device respectively;

FIGS. 12*c* and 12*d* illustrate the link elements of the second embodiment of the supporting device.

It is now referred to FIGS. 1-4.

A plugging device 1 comprises a housing 10 and a packer device 2 provided circumferentially around the housing 10.

The packer device 2 is configured to be provided in a retracted state and in an expanded state, where the outer radial radius R2 of the packer body 20 in the expanded state is larger than the outer radial radius R1 of the packer body 20 in the retracted state.

Figure 2:
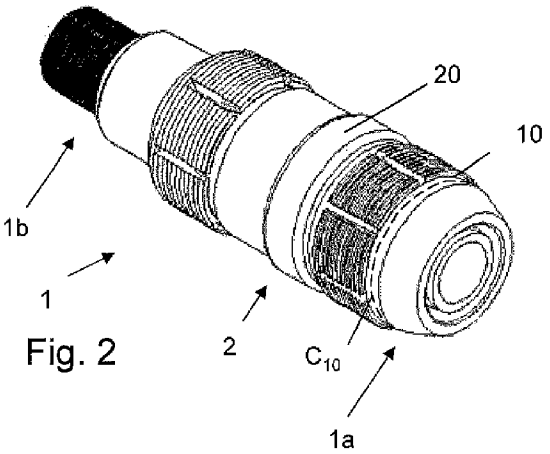
FIG. 2 illustrates a perspective view of the plugging device with a packer device in the expanded state.
Figure 3:
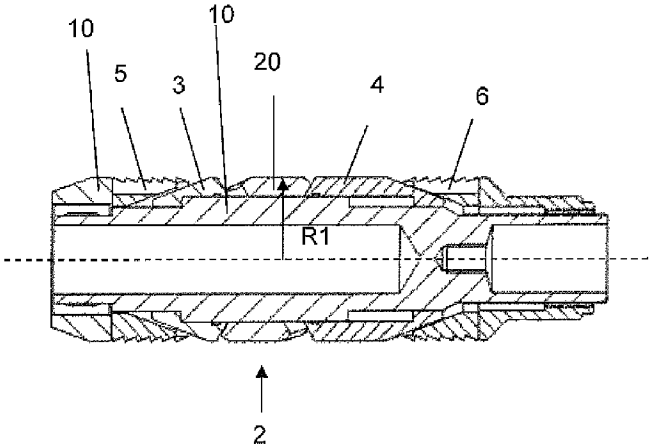
FIG. 3 illustrates a cross sectional view of the plugging device in FIG. 1.
Figure 4:
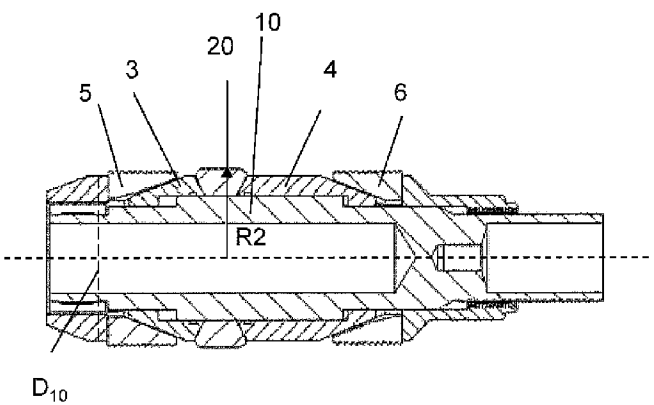
FIG. 4 illustrates a cross sectional view of the plugging device in FIG. 2.

The housing 10 has an outer circumference $C_{10}$ indicated in FIG. 2, and the corresponding diameter $D_{10}$ is indicated in FIG. 4. The plugging device 1 further comprises a first supporting assembly 3 supporting a first side 2*a* of the packer device 2 in the expanded state and a second supporting assembly 4 supporting a second side 2*b* of the packer device 2 in the expanded state. In the present embodiment, the term "first side" is used to denote the lower side of the plugging device 1, i.e. the side nearest the lower end 1*a* of the plugging device 1 that is going first into the pipe. The term "second side" is the longitudinal opposite of the first side, i.e. the upper side 1*b* of the plugging device. The upper side 1*b* comprises a connection interface for connection to a setting and/or retrieval tool (not shown). The central longitudinal axis of the plugging device is illustrated as a dashed line I in several of the drawings.

Figure 1:
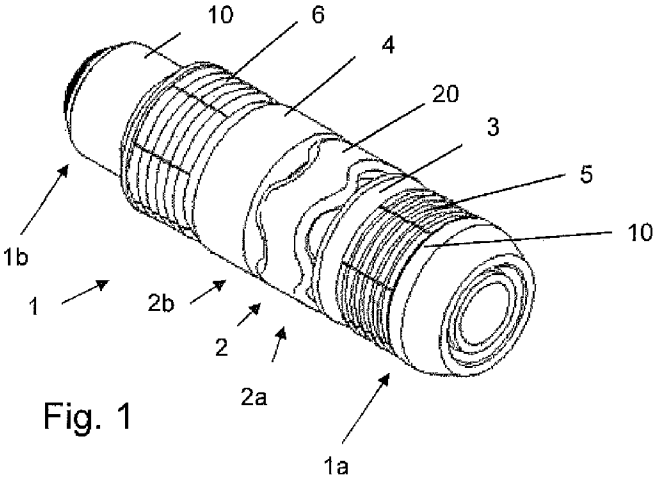
FIG. 1 illustrates a perspective view of a plugging device with a packer device in the retracted state.

In FIG. 1, the plugging device 1 and the packer device 2 are in a retracted state, with an outer radius less than the inner diameter of a pipe (not shown) that is to be sealed. When the first supporting assembly 3 and the second support assembly 4 are moved towards each other, the packer device 2 becomes axially compressed and hence radially expanded to an expanded state as shown in FIG. 2. In the expanded state, the packer device 2 seals towards the inner surface of the pipe. If the plugging device 1 is a retrievable plugging device 1, the first supporting assembly 3 and the second support assembly 4 may be moved away from each other, and hence pulling the packer device 2 back to its retracted state before retrieval out from the pipe.

The packer device 2 may be connected to the first supporting assembly 3 and the second support assembly 4 in order to pull the packer device 2 back to its retracted state. Alternatively, the packer device 2 may return to its initial (i.e. retracted state) state by itself due to the properties of the material of the packer device when the first and second supporting assemblies 3 and 4 are returned to their retracted positions.

In addition, the plugging device 1 may comprise first and second gripping assemblies 5, 6 which also have a retracted state (as in FIG. 1) and an expanded state (as in FIG. 2) to provide an initial grip towards the inner surface of the pipe. The first and second supporting assemblies 3, 4 and the first and second gripping assemblies 5, 6 are considered known for a person skilled in the art and will not be described further in detail here.

Embodiments of the packer device 2 will now be described in detail. The packer device 2 comprises a packer body 20 and a supporting device 30. The main purpose of the packer body is to seal against the inner wall of the pipe, while the main purpose of the supporting device 30 is to support the packer body 20 in the expanded state, i.e. to avoid extrusion of the packer body 20.

It is now referred to FIGS. 5*a* and 5*b*. Here, the supporting device 30 comprises a wavy, ring-shaped body of a ductile or semi-ductile material such as tin, lead or other relatively soft metals. Two grooves, one on the respective side of the body, are provided. One packer body 20 is provided in each groove of the supporting device 30. Hence, also the packer bodies 20 are formed as wavy, ring-shaped bodies. In the embodiment shown in FIGS. 5*a* and 5*b*, the packer bodies 20 are made of rubber, PEEK (polyether ether ketone), PTFE (polytetrafluoroethylene), or other suitable materials. In addition, the packer bodies 20 may also comprise other materials for reinforcement, such as glass, carbon fibers etc.

The packer body 20 and the supporting device 30 have the same circumference C in the retracted state and the expanded state. More specifically, the central circumference C (indicated in FIG. 5*b*) of the body formed by the packer body 20 and the supporting device 30 has the same length in the retracted state and the expanded state. Hence, when the wavy, ring-shaped body of FIG. 5*a* is axially compressed due to the axial movement of the first supporting assembly 3 and the second support assembly 4 towards each other, the packer device 2 becomes radially expanded. In the expanded state, the packer device 2 is no longer wavy, it will be substantially cylindrical or ring-shaped, as shown in FIG. 4.

It should be noted that it would be difficult or impossible to retract the packer device 2 of the first embodiment back to its retracted state. Hence, the plugging device 1 having such a packer device 2 will be a permanent plugging device.

It should also be noted that in an alternative embodiment, the packer body 20 and the supporting device 30 may be provided as one body made of the same ductile or semi-ductile material such as tin or lead, i.e. there are no grooves and no rubber material. Here, the material of such a packer device 2 will provide the sealing against the inner wall of the pipe and will also provide properties which avoid the extrusion.

In FIG. 5*a*, the first side 2*a* of the packer device 2 comprises six first contact areas 21 in which the packer device 2 is in contact with the first supporting assembly 3 in the retracted state. Moreover, the second side 2*b* of the packer device 2 comprises six second contact areas 23 in which the packer device 2 is in contact with the second supporting assembly 4 in the retracted state.

There are also six non-contact areas 22 longitudinally opposite of the respective first contact areas 21 and six non-contact areas 24 longitudinally opposite of the respective second contact areas 23 where there is no contact between the packer device 2 and the first and second supporting assemblies 3, 4 respectively. Hence, there is a distance (i.e. an axial distance) between each non-contact area 22 and the second supporting assembly 4 which is larger than zero and there is a distance (i.e. an axial distance) between each non-contact area 24 and the first supporting assembly 3 which is larger than zero.

The first side 2*a* of the packer device 2 is parallel to the second side 2*b* of the packer device 2 along the circumference of the packer device in the retracted state, i.e. the normal N1 is parallel to the normal N2 in FIG. 5*a*.

Second Embodiment

It is now referred to FIGS. 6 and 7. Here, there is one packer body 20, where the supporting device 30, hereinafter referred to as the first supporting device 30, is incorporated into the packer body 20. Moreover, the packer device 2 comprises a second supporting device 60 also incorporated into the packer body 20. The first and second supporting devices 30, 60 will be described in detail further below.

In FIG. 6 and FIG. 7 it is shown that the first side 2*a* of the packer device 2 comprises one first contact area 21 in which the packer device 2 is in contact with the first supporting assembly 3 in the retracted state. Moreover, the second side 2*b* of the packer device 2 comprises one second contact area 23 in which the packer device 2 is in contact with the second supporting assembly 4 in the retracted state. Since the first and second supporting devices 30, 60 are incorporated into the packer body 20, it is the packer body 20 that will be in contact with the first and second supporting assemblies 3, 4.

There are also a non-contact area 22 longitudinally opposite of the first contact area 21 and a non-contact area 24 longitudinally opposite of the second contact area 23 where there is no contact between the packer device 2 and the first and second supporting assemblies 3, 4 respectively. Hence, there is a distance D22 (i.e. an axial distance) between the non-contact area 22 and the second supporting assembly 4 which is larger than zero and there is a distance D24 (i.e. an axial distance) between the non-contact area 24 and the first supporting assembly 3 which is larger than zero.

In FIG. 6 it is shown that the distance D22=D24 and that the distance D22 is larger than the width D2 of the packer device 2 in the retracted state. The total (axial) length of the packer device 2 is equal to the sum of distances D2 and D22.

Consequently, in the retracted state, the first and second supporting devices 30, 60 are substantially oval, while in the expanded state, they are substantially ring-shaped. In the retracted state, the packer device 2 (and hence the packer body 20) is shaped as an oblique or inclined cylinder. More specifically, it is shaped as an inclined, circular cylinder. As the packer body 20 is provided circumferentially around the plugging device, an opening is provided through the packer body 20, i.e. the packer body is hollow. In a preferred embodiment, the packer body 20 is unstrained in the retracted state.

FIG. 9 shows the expanded state of the packer device 2 of FIG. 8, but the packer device 2 of FIG. 6 will have substantially the same shape in its expanded state. Here it is also shown that the packer body 20 is substantially cylindrical, or forms a circular cylinder. In FIGS. 6, 7 and 9, the central, longitudinal axis I of the plugging device is also indicated. As mentioned above, the packer body 20 is here compressed in a direction parallel to the central, longitudinal axis I of the packer body. Moreover, as mentioned above, the radial distance R1 between the central, longitudinal axis I and the outer surface of the packer body 20 in the retracted state is less than a radial distance R2 between the central, longitudinal axis I and the outer surface of the packer body 20 in the expanded state. It should also be noted that it is possible to use the packer body 20 without supporting devices 30, 60 for low pressure pipes.

Consequently, the first and second supporting devices 30, 60 have the same circumference C in the retracted state and the expanded state. Hence, there is no radial expansion of the first and second supporting devices 30, 60, and no openings occur in the supporting device in which the packer body 20 may extrude. By the term "there is no radial expansion" it is referred to FIG. 11*a* and FIG. 12 illustrating two embodiments of a supporting device 30, 60, which will be described more in detail below. When moving the packer device 2 from the retracted state (FIGS. 6 and 7) to the expanded state (FIG. 9) the supporting device will not be stretched, and there is no opening between the elements of the supporting device, hence no part of the packer body may extrude in between the elements of the supporting device. Of course, the radial radius measured from the centre axis of the plugging device to the supporting device in the retracted state (substantially corresponding to R1 in FIG. 3, depending on the location of the supporting device within the packer body) and the radial radius measured from the centre axis of the plugging device to the supporting device in the expanded state (substantially corresponding to R2 in FIG. 4, depending on the location of the supporting device within the packer body) will not be equal to each other. The radius R2 will also here be larger than radius R1. It should be noted that at least some of the material in the packer body will experience a radial expansion.

During the movement of the packer device from the retracted state to the expanded state the material of the packer body and the supporting device will be twisted and bent due to the axial compression, however, the strain on the materials will be reduced when compared to a prior art plugging device.

The material of the packer body 20 may be a flexible, elastic, ductile or semi-ductile material, such as rubber PEEK (polyether ether ketone), PTFE (polytetrafluoroethylene), or other suitable materials. Also other materials may be added, as described above.

Third Embodiment

It is now referred to FIGS. 8 and 9. The third embodiment is similar to the second embodiment and the same reference numbers are used. Hence, only the differences between the third embodiment and the second embodiment will be described.

In FIGS. 8 and 9 it is shown that the first side 2*a* of the packer device 2 comprises two first contact areas 21 in which the packer device 2 is in contact with the first supporting assembly 3 in the retracted state. Moreover, the second side 2*b* of the packer device 2 comprises two second contact areas 23 in which the packer device 2 is in contact with the second supporting assembly 4 in the retracted state. Since the first and second supporting devices 30, 60 are incorporated into the packer body 20, it is the packer body 20 that will be in contact with the first and second supporting assemblies 3, 4.

There are also a non-contact area 22 longitudinally opposite of each first contact area 21 and a non-contact area 24 longitudinally opposite of each second contact area 23 where there is no contact between the packer device 2 and the first and second supporting assemblies 3, 4 respectively. Hence, there is a distance D22 (i.e. an axial distance) between the non-contact area 22 and the second supporting assembly 4 which is larger than zero and there is a distance D24 (i.e. an axial distance) between the non-contact area 24 and the first supporting assembly 3 which is larger than zero.

In FIG. 8 it is shown that the distance D22=D24 and that the distance D22 is slightly less than the width D2 of the packer device 2 in the retracted state. The total (axial) length of the packer device 2 equals the sum of D2 and D22.

FIG. 9 shows the third embodiment in expanded state. Here, the first and second supporting devices 30, 60 are substantially ring-shaped. Here it is also shown that the packer body 20 is substantially cylindrical.

Consequently, the first and second supporting devices 30, 60 have the same circumference C in the retracted state and the expanded state.

The embodiment in FIGS. 9 and 10 result in a shorter total axial length than the total axial length of the embodiment in FIGS. 7 and 8. Consequently, the embodiment in FIGS. 9 and 10 requires a shorter setting length (i.e. a shorter relative movement between the first and second supporting assemblies 3, 4) in order to set the plugging device.

Fourth Embodiment

It is now referred to FIG. 10. The fourth embodiment is similar to the second and third embodiment and the same reference numbers are used. Hence, only the differences between the fourth embodiment and the second embodiment will be described.

Also the fourth embodiment comprises first and second supporting devices 50, 60 incorporated into the packer body 20.

In FIG. 10 it is shown that the first side 2*a* of the packer device 2 comprises six first contact areas 21 in which the packer device 2 is in contact with the first supporting assembly 3 in the retracted state. Moreover, the second side 2*b* of the packer device 2 comprises six second contact areas 23 in which the packer device 2 is in contact with the second supporting assembly 4 in the retracted state.

There are also a non-contact area 22 longitudinally opposite of each first contact area 21 and a non-contact area 24 longitudinally opposite of each second contact area 23 where there is no contact between the packer device 2 and the first and second supporting assemblies 3, 4 respectively. Hence, there is a distance D22 (i.e. an axial distance) between the non-contact area 22 and the second supporting assembly 4 which is larger than zero and there is a distance D24 (i.e. an axial distance) between the non-contact area 24 and the first supporting assembly 3 which is larger than zero.

As shown in FIG. 10, the packer device 2 is substantially wave-shaped or sinusoidal along its circumference.

Also here the first and second supporting devices 30, 60 have the same circumference C in the retracted state and the expanded state.

The embodiment on FIG. 10 results in an even shorter setting length than the embodiments of FIG. 7-9.

In all the embodiments above, the circumference C is larger than the circumference $C_{10}$ of the housing 10. This is achieved due to the oval shaped or wave shaped packer device 2 in the retracted state.

This embodiment of the packer device is used on the plugging device in FIG. 1-4. This embodiment have been tested to 7500 psi (517 bar) from 430 F (221° C.) to 100 F (37.8° C.) according to ISO 14 310 grad VO.

Supporting Device

A first embodiment of the supporting device 30 will now be described with reference to FIG. 11*a*. Here it is shown that the supporting device comprises a chain of interconnected chain elements 40.

In FIGS. 11*b*, 11*c* and 11*d* it is shown that each chain element 40 comprises an outwardly curved front end 42 and an inwardly curved rear end 43, where the front end 42 is adapted to be received by the rear end 43 of an adjacent chain element 40. The front end 42 may be outwardly hemispherical and the rear end 43 may be inwardly hemispherical. The chain element 40 may comprise a substantially cylindrical side surface 41 between the front end 42 and the rear end 43. A connection bore 44 is provided between the front end 42 and the rear end 43 of each chain element 40. A connection wire 70 is inserted through the connection bores 44 of each chain element and the ends of the connection wire 70 is connected to each other, thereby forming the chain as shown in FIG. 11*a*. The connection wire 70 is non-stretchable. The circumference C of the supporting device is shown as a dashed line in FIG. 11*a*.

A second embodiment of the supporting device 30 will now be described with reference to FIG. 12*a*. Here it is shown that the supporting device 30 comprises a chain of interconnected chain elements 50, 55, where a first chain element 50 comprises an inwardly curved front end 52 and an inwardly curved rear end 54 and where a second chain element 55 comprises an outwardly curved front end 57 and an outwardly curved rear end 58. Also here the circumference C is indicated.

The outwardly curved front end 57 of the second chain element 55 is adapted to be received by the inwardly curved rear end 53 of the first chain element 50 and the outwardly curved rear end 58 of the second chain element 55 is adapted to be received by the inwardly curved front end 42 of the first chain element 50.

Also here a connection bore 54, 59 is provided between the front end 52, 57 and the rear end 53, 58 of the respective first and second chain elements 50, 55, where a connection wire 70 is inserted through the connection bores 54, 59 of the respective chain elements and the ends of the connection wire 70 is connected to each other, thereby forming the chain as shown in FIGS. 12*a* and 12*b*. The connection wire 70 is non-stretchable.

In FIG. 12*d* it is shown that the second chain element 55 is spherical and that the front end 52 and the rear end 53 of the first chain element 50 is inwardly hemispherical. It should be noted that the second chain element 55 may comprise a substantially cylindrical side surface 56 between the front end 57 and the rear end 58. Also the first chain element 50 comprises a cylindrical side surface 51 between the front end 52 and the rear end 53.

It should be noted that the supporting device 30 described above with reference to FIG. 5 may also be incorporated into the packer body 20 of the second, third and fourth embodiment described above.

The supporting devices 30 described above are non-stretchable or substantially non-stretchable, i.e. its circumference will not be increased when the packer device 2 is axially compressed by the first and second supporting assemblies 3, 4.

The invention claimed is:

1. A plugging device comprising:

a housing;

a packer device provided circumferentially around the housing, wherein the packer device comprises a packer body and is configured to be provided in a retracted state and an expanded state, wherein a radial radius of the packer body in the expanded state is larger than the radial radius of the packer body in the retracted state;

a first supporting assembly supporting a first side of the packer device in the expanded state; and a second supporting assembly supporting a second side of the packer device in the expanded state, wherein the packer device comprises a supporting device for supporting the packer body in the expanded state, wherein the first and second sides of at least one of the packer device and the supporting device have a same circumference in the retracted state and the expanded state, wherein the circumference is larger than a circumference of the housing, wherein the supporting device comprises a chain comprising interconnected chain elements, and wherein a connection bore is provided between a front end and a rear end of each chain element and wherein a connection wire is inserted through the connection bore of each chain element.

2. The plugging device according to claim 1, wherein:

the first side of the packer device comprises at least one first contact area in which the packer device is in contact with the first supporting assembly in the retracted state;

the second side of the packer device comprises at least one second contact area in which the packer device is in contact with the second supporting assembly in the retracted state;

a distance between an area longitudinally opposite of the at least one first contact area and the second supporting assembly is larger than zero; and a distance between an area longitudinally opposite of the at least one second contact area and the second supporting assembly is larger than zero.

3. The plugging, device according to claim 2, wherein the first side of the packer device comprises two first contact areas and wherein the second side of the packer device comprises two second contact areas.

4. The plugging device according to claim 2, wherein the first side of the packer device comprises six first contact areas and wherein the second side of the packer device comprises six second contact areas.

5. The plugging device according to claim 1, wherein the chain elements comprise an outwardly curved front end and an inwardly curved rear end, and wherein the front end is adapted to be received by the rear end of an adjacent chain element.

6. The plugging device according to claim 5, wherein the front end is outwardly hemispherical and the rear end is inwardly hemispherical.

7. The plugging device according to claim 5, wherein the chain elements comprise a substantially cylindrical side surface between the front ends and the rear ends.

8. The plugging device according to claim 1, wherein the chain elements comprise:

a first chain element comprising an inwardly curved front end and an inwardly curved rear end;

a second chain element comprising an outwardly curved front end and an outwardly curved rear end, wherein the outwardly curved front end of the second chain element is adapted to be received by the inwardly curved rear end of the first chain element and the outwardly curved rear end of the second chain element is adapted to be received by the inwardly curved front end of the first chain element.

9. The plugging device according to chum 1, wherein the supporting device is incorporated into the packer body.

10. The plugging device according to claim 1, wherein the packer device is oval or wave-shaped in the retracted state, and cylindrical in the expanded state.

11. The plugging device according to claim 1, wherein the packer body is oval or wave-shaped in the retracted state, and cylindrical in the expanded state.

* * * * *